US009972150B2

(12) United States Patent
Da Deppo et al.

(10) Patent No.: US 9,972,150 B2
(45) Date of Patent: May 15, 2018

(54) METHOD OF VERIFYING USER INTENT IN ACTIVATION OF A DEVICE IN A VEHICLE

(71) Applicant: Huf North America Automotive Parts Mfg. Corp., Milwakuee, WI (US)

(72) Inventors: Lynn D. Da Deppo, Bloomfield Hills, MI (US); John Nantz, Brighton, MI (US); Yipeng Tang, Troy, MI (US); Khalid Kamal, Novi, MI (US); Cristian Murarescu, Milwaukee, WI (US); James Sanborn, Hudson, MI (US); Yi Luo, Northville, MI (US)

(73) Assignee: Huf North America Automotive Parts Mfg. Corp., Milwaukee, WI (US)

( * ) Notice: Subject to any disclaimer, the term of this patent is extended or adjusted under 35 U.S.C. 154(b) by 0 days. days.

(21) Appl. No.: 15/326,282

(22) PCT Filed: Jul. 15, 2015

(86) PCT No.: PCT/US2015/040520

§ 371 (c)(1),
(2) Date: Jan. 13, 2017

(87) PCT Pub. No.: WO2016/011125

PCT Pub. Date: Jan. 21, 2016

(65) Prior Publication Data

US 2017/0200335 A1 Jul. 13, 2017

Related U.S. Application Data

(60) Provisional application No. 62/024,798, filed on Jul. 15, 2014.

(51) Int. Cl.
*G07C 9/00* (2006.01)

(52) U.S. Cl.
CPC ..... *G07C 9/00111* (2013.01); *G07C 9/00309* (2013.01); *G07C 2209/63* (2013.01)

(58) Field of Classification Search
None
See application file for complete search history.

(56) References Cited

U.S. PATENT DOCUMENTS 5,288,938 A * 2/1994 Wheaton ..... G06K 9/00335 84/600
8,098,130 B2 * 1/2012 Baruco ..... B60R 25/245 340/426.36

(Continued)

FOREIGN PATENT DOCUMENTS

EP 1095198 A1 5/2001
EP 1733937 A1 12/2006
WO WO-2014064296 A1 5/2014

OTHER PUBLICATIONS

European Patent Office as the International Searching Authority, International Search Report and Written Opinion for Application No. PCT/US2015/040520, dated Oct. 6, 2015.

*Primary Examiner* — K. Wong
(74) *Attorney, Agent, or Firm* — Honigman Miller Schwartz and Cohn LLP; Matthew H. Szalach; Jonathan P. O'Brien

(57) ABSTRACT

Vehicular systems and related methods offer improved user control over activations of vehicular components. User intent to perform an action can be detected using one or more sensors. The user may be prompted by the vehicle to verify the intent by further user behavior. The intent may also be confirmed by requiring that a set of conditions be fulfilled before the action associated with the intent is performed. For example, a sensed gesture and specific position of a key fob may need to both be established before the vehicle performs the action associated with the intent.

23 Claims, 4 Drawing Sheets

(56) References Cited

U.S. PATENT DOCUMENTS

| | | | | |
|---|---|---|---|---|
| 9,340,155 | B2 * | 5/2016 | Pisz | B60H 1/00642 |
| 9,580,046 | B2 * | 2/2017 | Luu | E05F 15/73 |
| 9,646,436 | B1 * | 5/2017 | Campbell | G07C 9/00111 |
| 2011/0118946 | A1 | 5/2011 | Reimann et al. | |
| 2012/0158253 | A1 | 6/2012 | Kroemke et al. | |
| 2012/0249291 | A1 | 10/2012 | Holcomb et al. | |
| 2013/0151084 | A1 | 6/2013 | Lee | |
| 2015/0258962 | A1 * | 9/2015 | Khanu | B60R 25/2054 701/49 |

* cited by examiner

METHOD OF VERIFYING USER INTENT IN ACTIVATION OF A DEVICE IN A VEHICLE

CROSS-REFERENCE TO RELATED APPLICATIONS

The present disclosure is the national phase of International Application No. PCT/US2015/040520, filed Jul. 15, 2015 and claims the benefit of U.S. Provisional Patent Application No. 62/024,798, filed Jul. 15, 2014, both of which are hereby incorporated by reference in their entirety.

STATEMENT REGARDING FEDERALLY SPONSORED RESEARCH OR DEVELOPMENT

None

BACKGROUND

In recent years, wireless communications have become increasingly important in a number of vehicle control systems. Remote vehicle entry transmitters/receivers, for example, are used for locking and unlocking a vehicle door, unlatching a trunk latch, starting the vehicle, or activating or deactivating an alarm system equipped on the vehicle. This remote entry device is commonly referred to as a remote keyless entry (RKE) fob. The RKE fob is typically a small rectangular or oval plastic housing with a plurality of depressible buttons for activating each one of the wireless operations. The RKE fob is carried with the operator of a vehicle and can wirelessly perform these functions when within a predetermined reception range of the vehicle. The RKE fob communicates with an electronic control module within the vehicle via a radio frequency (RF) communication signal.

Even more recently, complex embedded electronic systems have become common to provide access and start functions and to provide wide ranging functions to improve driver safety and convenience. These systems include Passive Entry and Passive Start (PEPS) systems which include a remote receiver and transmitter (or transceiver) and an electronic control module disposed within the vehicle. In a PEPS system, a remote transceiver is carried with the user in a portable communication device such as a key fob or a card. The portable communication device when successfully challenged transmits an RF signal to a PEPS module within the vehicle which starts the authentication process to validate the user. The PEPS module in turn sends status information on a system vehicle bus to other vehicle control modules which perform a variety of tasks such as door lock/unlock, enabling engine start, or activating external/internal lighting.

In addition to keyless and passive entry systems, "gesture recognition" has become important for accessing vehicles. Capacitive sensors include a sensor electrode or multiple electrodes which can detect an object in a "detection area" space in front of the sensor electrode(s). In one type of system, for example, a control and evaluation circuit is coupled to the sensor electrode and detects a change in the capacitance of the sensor electrode with respect to a reference potential. These sensors can be coupled to a non-metallic portion of the vehicle, such as the region of a lower sill area, lower fender or bumper, and are typically used to operate (open/close) a door of a motor vehicle, a trunk, or a tailgate by detecting the approach of a body part. For example, a pivoting movement of a leg/foot under the bumper and forward under it can serve as a command to open or close the trunk or tailgate to a control device in the motor vehicle. The "gesture sensor" can, in some applications, be combined and monitored in conjunction with the proximity of a keyfob or PEPS device to assure that the person providing the "gesture" also has the right to access the vehicle.

SUMMARY

While sensors are very helpful to vehicle users to simplify the opening and closing of doors and other access points, the activation of certain devices or operations occurs contemporaneously with the action of the user. Although the contemporaneous activation of a device when the user performs a pre-defined action is beneficial in many contexts such as, for example, the unlocking of doors when the user places his or her hand on the handle strap, such contemporaneous action is often inconsistent with the intent of the user and can frustrate the operation of the device. As one example of when a user action may be inconsistent with a user intent, a sensor may be configured to open the tailgate upon a kick action of the user below the bumper. However, in such an arrangement, it is very easy for the system to misinterpret the action of a user or miscue the activation of the device, in this instance, the release and opening of the rear hatch. For example, a user may inadvertently place their foot or another object in the region of the sensor and the rear hatch may be made to open, when the actual intent of the user was not to have the device perform this action.

Disclosed herein are improvements to such systems in order to better confirm or verify the intent of the user to perform a particular activation of a device.

In one aspect of the invention, a method is provided for activating a device for an automotive vehicle in which a localized field is generated using a field generator and, when the presence of a user is detected in the localized field, a perceivable system response is provided acknowledging the presence of the user in the localized field. At this point, the user is apprised or informed (by the perceivable system response) that their subsequent action will establish whether the device is to be activated. In one instance, the device is activated if the user is detected to have moved away from the field generator within a predetermined amount of time after the perceivable system response has been provided, thereby indicating the intent of the user to activate the device. If the user is not detected to have moved away from the localized field (or has not done so to a predetermined extent) within the predetermined amount of time after the perceivable system response has been provided (thereby indicating that the user intends to not activate the device), then the device is not activated. It is contemplated that a vehicle can include a system programmed to perform this method and both the vehicle and the system capable of performing this method are contemplated as falling within the scope of this disclosure.

In another aspect of the invention, a method is provided for activating a device for an automotive vehicle in which a first predetermined motion of the user for activation of the device is detected and, after the detection of this first predetermined motion, a perceivable system response is provided acknowledging the first predetermined motion of the user for activation of the device. At this point, the device is activated if (1) the user is detected to have moved away from a field generator or (2) if the user is detected to have performed a second predetermined motion, either of which actions are indicative of an intent of the user to activate the device. If neither of these conditions (1) or (2) have occurred, then the system understands that the user does not have the intent to activate the device. Again, it is contemplated that a vehicle can include a system programmed to perform this method and both the vehicle and the system capable of performing this method are contemplated as falling within the scope of this disclosure.

In still another aspect of the invention, a method is provided for activating a device for an automotive vehicle in which a gesture sensor supported by the vehicle monitors for a gesture. A gesture is detected using the gesture sensor and then a position of a key fob is detected relative to the vehicle. An action associated with the gesture and the position of the key fob is then performed by the vehicle.

In some forms, the gesture sensor may be supported by a tail lamp assembly of the vehicle.

In some forms, the step of detecting a position of the key fob relative to the vehicle includes separately and simultaneously detecting the key fob using at least two independent sensors for detecting the key fob in which the independent sensors for detecting the key fob define an overlapping area. This overlapping area includes an area including the gesture sensor. In this way, the presence of a user at or in the proximity of the gesture sensor can be established.

In another aspect of the invention, the corresponding action associated with each of the gesture sensors and the position of the key fob may differ between the various gesture sensors.

In some forms, performing an action associated with the gesture and the position of the key fob may include opening a vehicle closure (such as, for example, a door, a trunk, a tail gate, and so forth). However, the vehicle may be programmed to perform other functions upon the detection of a gesture and a key fob in a particular location.

These and other aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefore, to the claims herein for interpreting the scope of the invention.

DETAILED DESCRIPTION

As used herein, the term "gesture" refers to a movement of a part of a body of a human or user to express the user's intent. Gestures include, but are not limited to, movements involving hands, feet, and other body parts.

As used herein, the term "gesture sensor" refers to a sensor that detects the gesture of a human or user. Such a gesture sensor detect the gesture in a number of ways including, but not limited to, visually sensing the gesture, sensing the gesture using a proximity sensor, sensing the gesture by changes in a generated field (such as an electrical field), and so forth. Various types of sensor may be potentially combined to provide more accurate sensing results.

Figure 1:
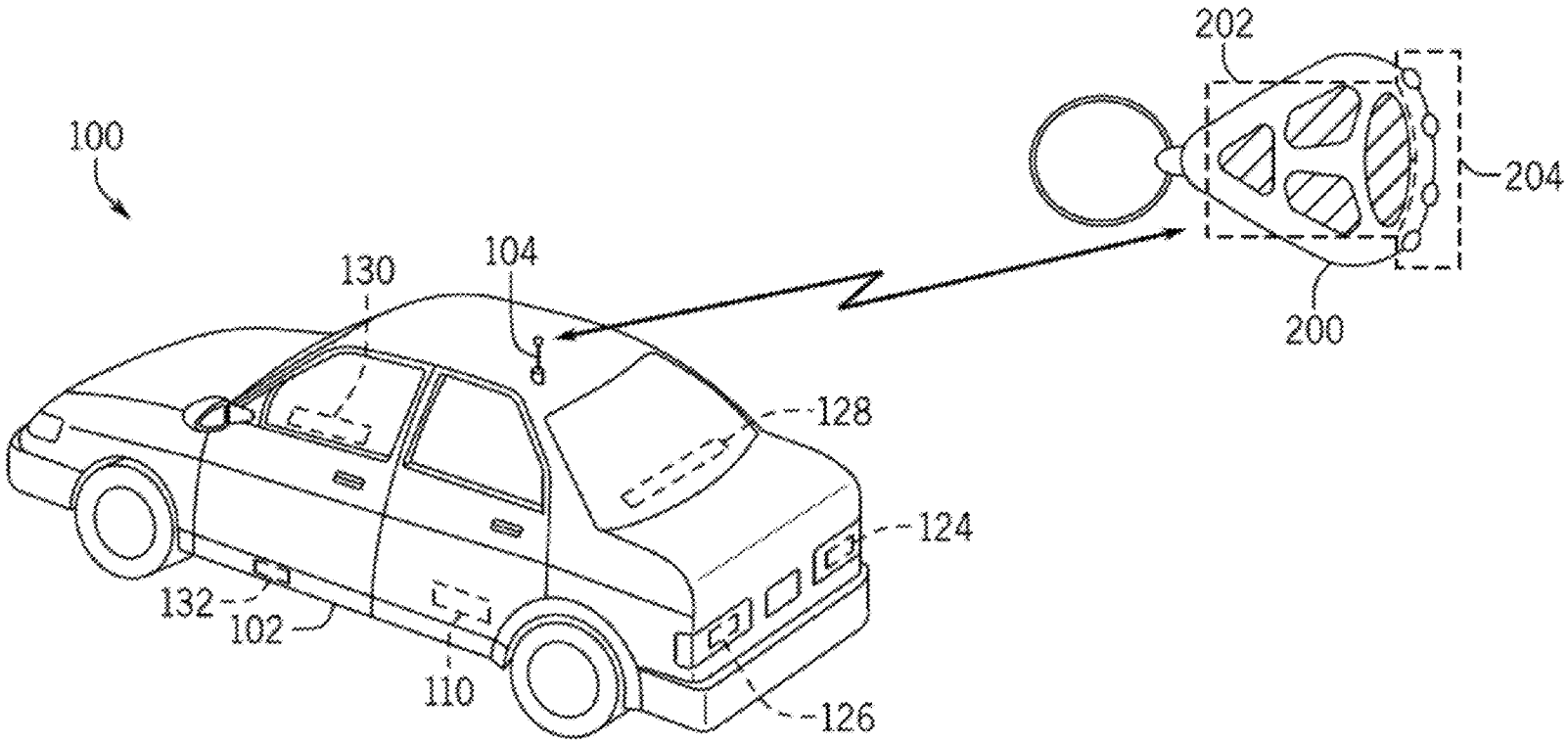
FIG. 1 illustrates a vehicle with a number of integrated sensors and key fob associated with the vehicle.
Figure 2:
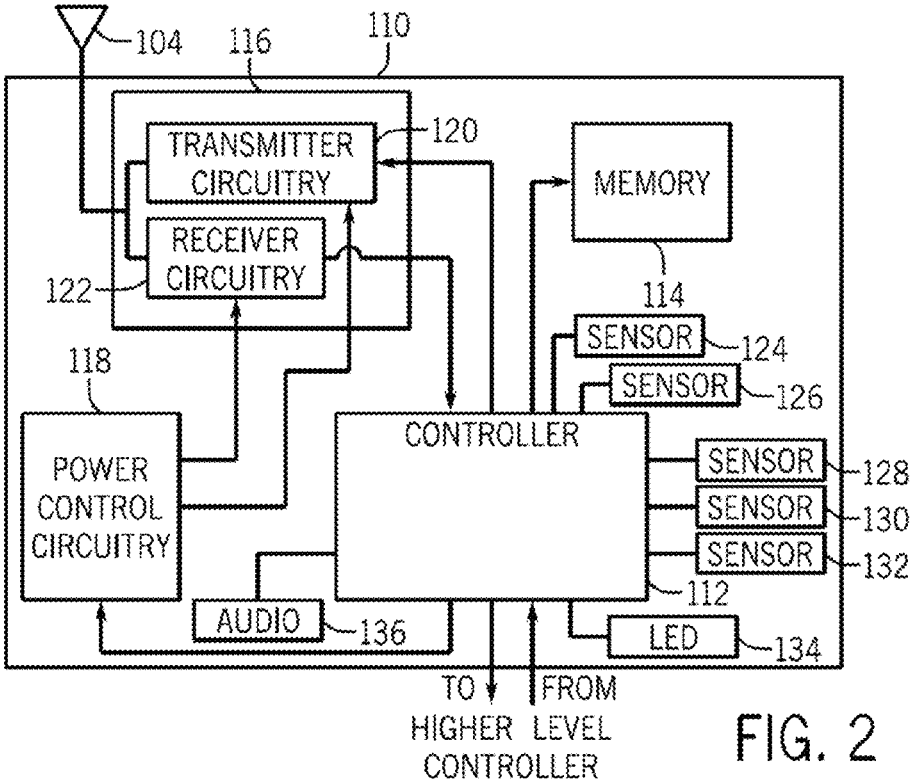
FIG. 2 is a block schematic of the vehicle of FIG. 1 indicating various electrical components of the vehicle.

Referring to FIGS. 1 and 2, a wireless vehicle communication system 100 is shown. The system 100 comprises a vehicle 102 including a vehicle transceiver module 110 having an antenna 104 communicating with a mobile electronic user device 200, which here is shown and described as a key fob. It will be apparent that the mobile electronic user device 200 can be many types of application-specific or personal computerized devices, including, for example, transponder cards, personal digital assistants, tablets, cellular phones, and smart phones. Communications are typically described below as bi-directional between the vehicle transceiver module and the key fob 200 and other devices, although it will be apparent that in many applications one-way communications will be sufficient.

One or more capacitive gesture sensors can be embedded in the vehicle 102 as illustrated in FIGS. 1 and 2. As shown here, sensors 124 and 126 are embedded in the back tail lights. Sensors 128 and 130 are embedded in the glazing adjacent the window. Sensor 132 is embedded behind cladding along a bottom edge of the vehicle 102, or an appliqué that is attached to the vehicle. Each of these capacitive sensors 124, 126, 128, 130, and 132 is therefore positioned to provide access points for a user to provide gesture control and is provided adjacent a non-conductive portion of the vehicle.

Figure 3:
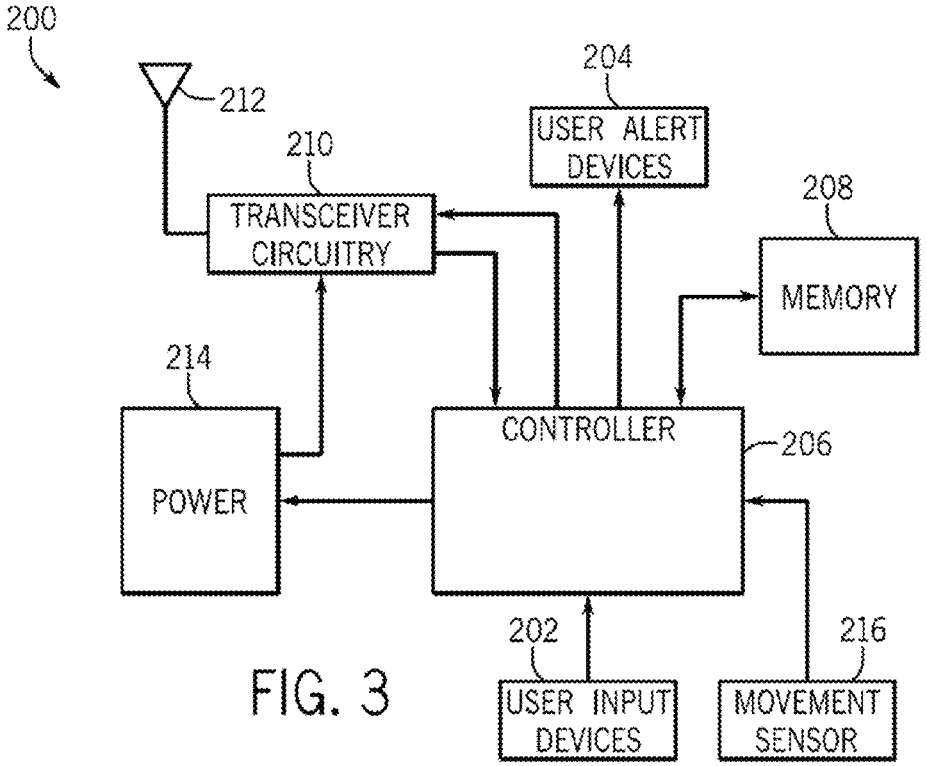
FIG. 3 is a block schematic of the key fob of FIG. 1 indicating various electrical components of the key fob.

Referring to FIGS. 1 and 3, the key fob 200 can include one or more user input devices 202 and one or more user output or alert devices 204. The user input devices 202 are typically switches such as buttons that are depressed by the user. The user output alert devices 204 can be one or more visual alert, such as light emitting diodes (LEDs), a liquid crystal display (LCD), an audible alarm, or a tactile or vibratory device. A single function can be assigned to each input device 202 or user alert device 204, or a combination of input devices or a display menu could be used to request a plethora of functions via input device sequences or combinations. Key fobs can, for example, provide commands to start the vehicle, provide passive entry (that is, automatic unlocking of the doors of the vehicle 102 when key fob 200 is within a predetermined proximate distance of the vehicle 102), activate external and internal vehicle lighting, preparation of the vehicle locking system, activation of a vehicle camera for vehicle action in response to camera-detected events, opening windows, activating internal electric devices, such as radios, telephones, and other devices, and adjustment of driver preferences (for example, the position of the driver's seat and the tilt of the steering wheel) in response to recognition of the key fob 200. These functions can be activated by input devices 202 or automatically by the vehicle 102 detecting the key fob 200. Although a single key fob is shown here, it will be apparent that any number of key fobs could be in communication with the vehicle transceiver module, and the vehicle transceiver module 110 and corresponding control system could associate a different set of parameters with each key fob.

In addition, the vehicle transceiver module 110 can activate output or alert devices 204 to notify the vehicle user that the key fob 200 is within communication distance or some other predetermined distance of the vehicle 102, notify the vehicle user that a vehicle event has occurred (e.g., activation of the vehicle security system), confirm that an instruction has been received from the key fobs 200, or that an action initiated by key fob 200 has been completed.

Now with specific reference to FIG. 2, a block diagram of an exemplary vehicle transceiver module 110 that can be used in accordance with the disclosed system 100 is illustrated. The vehicle transceiver module 110 includes a processor or controller 112, memory 114, a power supply 118, and transceiver circuitry 116 communicating through the antenna 104.

The transceiver circuitry 116 includes receiver circuitry 122 and transmitter circuitry 120 for bi-directional communications. The receiver circuitry 122 demodulates and decodes received RF signals from the key fob 200, while the transmitter provides RF codes to the key fob 200, as described below.

The memory 114 stores data and operational information for use by the processor 112 to perform the functions of the vehicle transceiver module 110, and to provide the vehicle function(s) described above. The controller 112 is also coupled to a higher level vehicle controller or controllers (not shown), which can include, for example, a vehicle bus such as a Controller Area Network (CAN) bus system and corresponding vehicle control system, and can both receive command signals from the vehicle control system and provide command signals and other information to the vehicle control system. Information available to other devices from the CAN bus or other online vehicle bus may include, for example, vehicle status information regarding vehicle systems, such as ignition status, odometer status (distance traveled reading), wheel rotation data (for example, extent of wheel rotation), and so forth. Vehicle status data can also include status of electronic control systems including among others, Supplemental Restraint Systems (SRS), Antilock Braking Systems (ABS), Traction Control Systems (TCS), Global Positioning Systems (GPS), environmental monitoring and control systems, Engine Control Systems, cellular, Personal Communications System (PCS), satellite-based communication systems, and many others not specifically mentioned here.

The transceiver 110 is coupled to the antenna 104 for receiving radio frequency (RF) signals from the key fob 200 and transmitting signals to the key fob 200. Although the antenna 104 is shown as being external to the vehicle transceiver module 110 and on the exterior of the vehicle 102, the antenna 104 may also be implemented within the confines of the vehicle 120 or even within the vehicle transceiver module. A number of antennas can be embedded, for example, in the headliner of a vehicle, or elsewhere within a vehicle. Although a bi-directional transceiver 110 is shown, it will be apparent that one-way communications from the key fob 200 to the vehicle 102, or from the vehicle 102 to the key fob 200 can also be provided, and that both a transmitter and receiver would not be required.

Referring still to FIG. 2, the capacitive sensors 124, 126, 128, 130, and 132 are electrically connected to the controller 112 which periodically couples a sensor electrode to an operating voltage at a predefined frequency and evaluates at least one of a current or voltage profile to detect a change in the capacitance of the sensor electrode with respect to ground. The current or voltage profile depends on the charge accumulated by the sensor electrode during periodic charging cycles in which the sensor electrode is coupled to the operating voltage and then discharged by the capacitor. Circuits of this type are shown, for example, in U.S. Pat. No. 5,730,165, which is hereby incorporated by reference for its description of such a device.

Alternatively, the capacitive sensors can include a sensor electrode, a ground electrode, and a guard electrode. The ground electrode is arranged behind the sensor electrode, and the guard electrode is arranged between the sensor electrode and the ground electrode. The guard electrode is coupled to the sensor electrode by the controller 112 in such a manner that its potential tracks the potential of the sensor electrode. These types of sensors are described, for example, in U.S. Pat. No. 6,825,752, which is hereby incorporated by reference for its description of such a device. Here, the guard electrode provides increased sensitivity of the capacitive sensor in the space in front of the sensor electrode because the field emanating from the sensor electrode extends a greater distance in the detection region of the sensor electrode because a significant portion of the field for the background electrode is no longer short-circuited, as compared to the capacitive sensor without a guard electrode, described above.

Referring still to FIG. 2, a gesture identifier, such as a light 134 or audio output 136 can be driven by the controller 112 when a gesture is detected. The light 134 can, for example, be an LED, OLED or other type of lighting element that is embedded adjacent the corresponding capacitive sensor. A light, for example, can be useful for use with capacitive sensors 124 and 126 embedded in the tail lights. As one potential example, the tail light itself could also be activated when a gesture is detected. Audio output can be correlated with specific sensors to provide different frequencies, tunes, or other audio variations depending on the access point.

Referring now to FIG. 3, a block diagram of an exemplary key fob 200 that can be used in accordance with the disclosed system includes a controller 206, memory 208, transceiver 210 and corresponding antenna 212, and a power supply 214 (such as a battery). User input devices 202 and user alert devices 204 are in communication with the controller 206. The transceiver circuitry 210 includes receiver circuitry and transmitter circuitry, the receiver circuitry demodulating and decoding received RF signals to derive information and to provide the information to the controller or processor 206 to provide functions requested from the key fob 200. The transmitter circuitry encodes and modulates information from the processor 206 into RF signals for transmission via the antenna 212 to the vehicle transceiver 110.

Although many different types of communications systems could be used, conventional vehicles typically utilize four short-range RF based peer-to-peer wireless systems, including Remote Keyless Entry (RKE), Passive Keyless Entry (PKE), and Immobilizer and Tire Pressure Monitoring System (TPMS). RKE and TPMS typically use the same high frequency with different signal modulation (315 MHz for US/NA, 433.32 MHz for Japan and 868 MHz for Europe), whereas the PKE system often requires a bidirectional communication at a low frequency (125 KHz) between the key fob and the receiver module and a unidirectional high frequency communication from key fob to the receiver module. The immobilizer system also typically uses a low frequency bidirectional communication between the key fob and the receiver module. Receivers for these systems are often standalone and/or reside in various control modules like Body Control Module (BCM) or Smart Junction Block (SJB). By using different radios with different carrier frequencies and/or modulation schemes, collisions between transmissions from separate wireless communication systems in the vehicles can be avoided.

The antenna 212 located within the fob 200 may be configured to transmit long-range ultra-high frequency (UHF) signals to the antenna 104 of the vehicle 100 and receive short-range Low Frequency (LF) signals from the antenna 104. However, separate antennas may also be included within the fob 200 to transmit the UHF signal and receive the LF signal. In addition, antenna 104 and other antennas in the vehicle may be configured to transmit LF signals to the fob 200 and receive UHF signals from the antenna 212 of the fob 200. Also, separate antennas may be included within the vehicle 102 to transmit LF signals to the fob 200 and receive the UHF signal from the fob 200.

The fob 200 may also be configured so that the fob controller 206 may be capable of switching between one or more UHF channels. As such, the fob controller 206 may be capable of transmitting a response signal across multiple UHF channels. By transmitting the response signal across multiple UHF channels, the fob controller 206 may ensure accurate communication between the fob 200 and the vehicle transceiver 110.

Referring still to FIG. 3, a motion detection device, such as a movement sensor 216, can optionally be included in the key fob 200 to detect movement of the key fob 200. The controller 206 can, for example, utilize the motion or lack of motion detected signal from the movement sensor 216 to place the key fob 200 in a sleep mode when no motion is detected for a predetermined time period. The predetermined time period during which no motion is detected that could trigger the sleep mode could be a predetermined period of time or a software configurable value. Although the motion detection device is here shown as part of the key fob, a motion detection device could additionally or alternatively be provided in the vehicle 102.

The vehicle transceiver 110 may transmit one or more signals without an operator activating a switch or pushbutton on the key fob 200, including a wakeup signal intended to activate a corresponding fob 200. The fob 200 may receive signals from the transceiver 110 and determine the strength or intensity of the signals (Received Signal Strength Indication (RSSI)), which can be used to determine a location of the fob 200.

According to one aspect of operation, one or more devices may be activated using the following method of operation in which the presence of a user is detected and then a user intent to activate the device is established before the device is activated. Various types of devices may be activated using this method including, but not limited to, vehicle closures and powered devices. Some examples of vehicle closures are lift gates and doors including sliding doors, hinged doors, gull wing doors, and so forth. Some examples of powered devices are pick-up tailgates, power running boards, windows of various types (dropping, sliding, flipping, and so forth), moon roofs and sun roofs, step in features, locked cargo stowage boxes, hood presenters, deployable handles, and covers such as fuel door covers.

According to the method, the user enters a localized field surrounding the vehicle 102 and this user entrance into the localized field is detected by the system. In some embodiments, the system may use Doppler to detect the presence of a user in the localized field. In other embodiments, one or more capacitive sensors, such as the specific sensors 124, 126, 128, 130, and 132 surrounding the vehicle 102, are used to detect the user in the localized field. In still other embodiments, wireless protocols such as E-field communication, H-field communication, LF, RF/LF including an LF/RFID security validation signal, HF, or microwave may be utilized. In still yet other embodiments, visual and/or optical user detection may be used. Further, various combinations of Doppler, capacitive, wireless, and visual/optical field detection may be utilized in combination with one another. As one illustrative example, the detection of the entrance of the user into the localized field may occur by one or more of the specific sensors 124, 126, 128, 130, and 132, may occur by detection of the key fob 200 (using for example LF or RFID communication with the antenna 104), or may occur by some combination thereof.

It is contemplated that, in some forms of the method, the localized field may only be generated or read upon after some other precursor user detection criterion has been satisfied. For example, a specific localized field generated by a capacitive sensor may be monitored once the localized presence of a key fob or RFID tag is detected. In this way, a comparably low power detection mechanism can activate the localized field for another more accurate, but perhaps more power intensive, user presence or location detection mechanism.

At this point, with the user detected in the localized field, a perceivable system response is provided by the system that acknowledges the presence of the user. This perceivable system response may be audible (for example, a beep, buzzer or so forth), may be visible (for example, a light, visual indictor, or so forth), or may be some combination of an audible and visible signal. As one example based on the illustrated figures, a light 134 may provide a visual indictor and audio output 136 may provide an audible indicator. In another example, the perceivable system response could be elicited by the key fob.

Then, within a pre-established time period from the acknowledgement of the user by the provision of the perceivable system response, the user may move away from the field generator in order to signal the user's intent to activate the particular device (which corresponds to the one or more specific sensors producing or monitoring the localized field). It is contemplated that the user does not have to move out of field entirely to indicate this intent, but may move only enough for the system to perceive a field change in the localized field. For example, the user may move relative to the localized field in order to exceed a pre-determined field change value. If no change in user presence relative to the localized field is detected or observed within the prescribed period, then the system assumes the user did not have the intent to activate the device. Once and if the user has met the criterion of the system to express an intent to activate the device, then the device is activated (for example, a vehicle closure is opened). It is noted that, if the user does not move out of the field to indicate an intent to operate the device, then after a prescribed period of time, the device will not be activated when the users moves out of the localized field as the opportunity to activate the device will have timed out. In order to activate the device after this time out condition, the user will need to exit and re-enter the localized field in order to reset the timer in which movement out of the field will be interpreted as an intent to activate the device.

If the activation of the device is for a secured portion of the vehicle, such as a locked door, then an initial or continual polling for an authorizing device (using, for example, LF/RFID) such as the typical unlock signal may be utilized. In such secured situations, the device may only be operable if at some or various points in time, the authorizing device is detected by the system. However, for operation of non-secure elements or devices, such initial or continual polling for an authorizing device may not be utilized.

In this way, a standalone system is provided that could be used to selectively activate a device in or on the vehicle by detecting the presence of the user, providing a perceivable system response indicating the system is monitoring for confirmation of activation, and further detecting an intent of the user to activate the device. However, it is also contemplated that this system and the method of operation of this system could be used with existing sensor systems such as, for example, kick-type sensors in which the user places his or her foot in a particular position to instruct the opening of a rear hatch. In such systems, an audible beep and/or visual signal may be elicited once the user has entered the region of the kick sensor. Then, if the user removes his or her foot within a certain time duration from the perceivable system response (for example, three seconds), then an activation of the corresponding device such as an opening of the rear hatch occurs. A system of this type can be used to improve confirmation of action and mitigate miscues or false activation.

According to another aspect of operation of the system, a specific motion of the user could instead be used to signal to the system that a device is intended to be activated. The verification method described above for the presence-type detection system could be used for signaling verification of intent by the user, or a second predetermined motion could be made to do this.

As with the previously described method, if the activation of device is for a secured portion of the vehicle, there may again be an initial or continual polling for an authorizing device (e.g., LF/RFID in a key fob) such as the typical unlock signal. For activation of a secure device, the initial or continual detection of an authorizing device may be utilized; however, for non-secure elements, this secure authorization may not be utilized.

In any event, the alternative method can include the user performing a predetermined motion or gesture which is read by one or more sensors in the system for activation of the device. This might be, for example, a gesture that occurs in the vicinity of a capacitive sensor formed in the tail light.

Once the predetermined motion or gesture has been detected by the system, then a perceivable system response acknowledging the intent is provided. As mentioned above, this perceivable system response may be audible, visual, or some combination thereof.

Then, within a pre-established time period from the perceivable system response, the user may move away from the field generator (which, as noted above, may be entirely moving out of the range of the field generator or may be only a partial movement out of field which results in a change of field which is sufficient for the system to perceive the user intent) or may perform a second predetermined motion (for example, gesture) that signals or verifies an intent of the user to activate the device. However, if no change in user presence or no expected confirmation motion is seen within the prescribed period, then the system assumes that the user did not have intent to activate the device and no activation of the device occurs.

Again, the system may comprise one or more field types described above. The placement of these fields would be such that the fields would detect field changes as the motion through the field is done by the user. For example, a set of capacitive fields may be set in place such that as, for instance, a hand is passed through the field from right to left, the right most field senses the user presence before the left field senses the presence, thus indicating user intent to activate a device. A second motion is then done in a pre-determined time to confirm intent and the device is activated.

Figure 4:
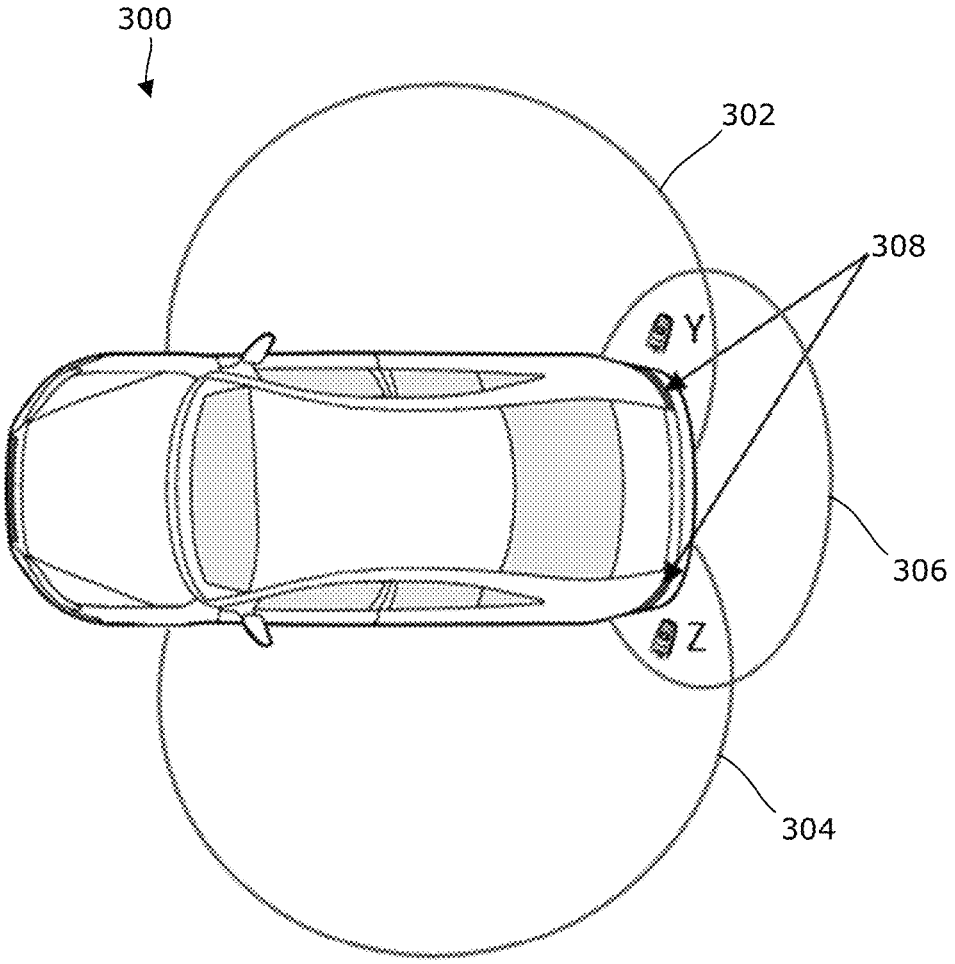
FIG. 4 is a top-down view of a vehicle having various localized fields and a pair of gesture sensors in the rear taillights.
Figure 5:
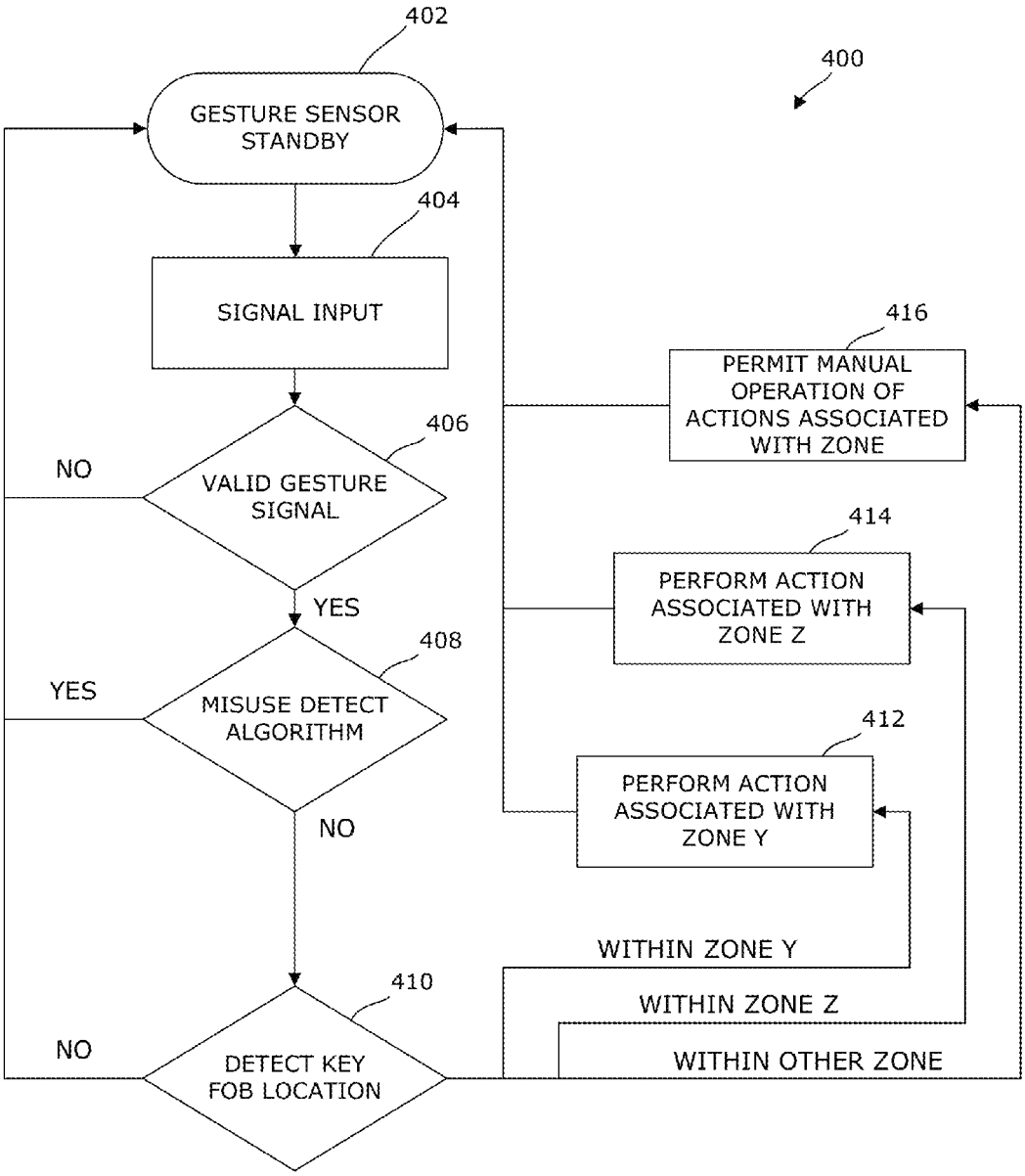
FIG. 5 is a flow chart providing logic for the operation of a device on the vehicle of FIG. 4, such as opening or closing the side doors or tailgate, using the illustrated localized fields and gesture sensors from FIG. 4.

Now with reference to FIG. 4, a vehicle 300 having multiple localized fields including right side field 302, left side field 304, and rear field 306 and a pair of gesture sensors 308 are illustrated along with a corresponding operational flowchart in FIG. 5. The right side field 302 and the rear field 306 overlap to form a zone Y which is associated with and in close proximity to the right tail light. The left side field 302 and the rear field 306 overlap to form a zone Z which is associated with and in close proximity to the left tail light.

In this vehicle 300, a traditional PEPS system has enhanced by the integration of one or more gesture sensors in the form of the pair of rear gesture sensors 308. In the form illustrated, these gesture sensors 308 are part of the rear tail lights; however, in other forms, one or more such gesture sensors could be mounted anywhere on the vehicle and localized field(s) established around those alternative locations.

Each of the gesture sensors 308 may be positioned in number of ways in relation to a tail lamp or other external vehicle apparatus on which they are positioned. Some non-limiting examples of sensor assemblies for tail lights may be found in U.S. Pat. No. 7,068,159 granted on Jun. 27, 2006 which is incorporated by reference as if set forth in its entirety herein for all purposes.

The system operation may begin when the PEPS system is activated by one of the gesture sensors 308 positioned on or embedded in the vehicle exterior. The PEPS system then begins polling for the specific location of the key fob (such as the previously-described key fob 200) within the predetermined set of zones including the right side field 302, the left side field 304, and the rear field 306. Once the system has determined the key fob is in a particular zone or set of overlapping zones, then the vehicle responds according to a predetermined action associated with that location (for example, a side door may slide open or lift gate, tail gate, or trunk may be unlatched, lifted, or opened). It is contemplated that the PEPS system could have a unique zone function definition for each of the zones around the exterior of the vehicle 300 or overlap of multiple zones. These functions may be different from or also included with the PEPS traditional entry process.

An exemplary flow chart 400 for such a system is shown in FIG. 5. During a rest state of the vehicle 300, the vehicle 300 is in a state of "gesture sensor standby" according to step 402 in which a gesture input is being awaited by the user. Even before this step 402 of standby, and as noted above, it is contemplated the gesture sensors themselves may be normally deactivated to conserve vehicle power and only activated upon the detection of a fob in the general region of the vehicle (regardless of the sensing of the fob in a particular field or zone) because fob detection can be performed with less power expenditure. Regardless, at some point with the gesture sensors 308 active, a user may present a gesture input at one of the gesture sensors 308 by, for example, placing their hands on or close to one of the tail lamps including the gesture sensors 308 according to step 404. This received signal input may optionally be run through a filter such as a digital low pass filter and this conditioned signal can be tested to determine whether it constitutes a valid gesture signal according to step 406 and may be subjected to a misuse detection algorithm at step 408. It will be appreciated that the steps 406 and 408 are exemplary in nature and steps 406 and 408 may be performed in the illustrated order, reverse order, or aspects of these steps may be combined into a single step or potentially omitted. To determine whether the gesture signal is valid, the signal or conditioned signal can be qualitatively compared to acceptable signals. Various conditions or tests may be applied or run on the signal or the conditioned signal to determine the validity of the signal. As one example, the time duration of the signal may be measured and compared to a pre-determined threshold duration for a valid gesture. Similarly, the strength of a signal may be examined to determine if the signal is valid. If the observed gesture signal is not a valid gesture signal, then the system might immediately return to the state of gesture standby in step 402 and await reception of another gesture signal. The gesture signal can be additionally tested in step 408 by a misuse detection algorithm. The misuse detection algorithm may employ one or multiple tests to determine whether the gesture is valid and not in error or may detect other conditions relating to the validity of the request. Effectively, the misuse detection algorithm attempts to eliminate false positives by evaluating the signals and conditions associated with the signal input to exclude non-user intended instruction, even on a signal that appears otherwise valid. If misuse is detected, then the system returns to step 402 for standby and no action is taken.

If misuse is not detected and the gesture signal is validated, the key fob location can be more specifically or locally detected according to step 410 using one or more sensors or localized fields. Then, depending on the particular zone or localized field in which the fob is detected as being located, various operations can potentially be performed. For example, if the fob is detected within zone Y (which corresponds to overlapped combined intersection of the right side field 302 and the rear field 306 the rear right tail light), then an action associated with zone Y can be performed according to step 412; for example, a signal may be sent to the side door to open in a left or right direction as appropriate. As another example, if the fob is detected within zone Z (which corresponds to the overlapped combined intersection of left side field 304 and rear field 306 proximate the rear left tail light), then an action associated with zone Z can be performed according to step 414; for example, a signal may be sent to open the tail gate. In this way, each of the tail lights effectively can serve as a button for a predefined function. In some forms, another alternative action might be initiated or if the fob is not received in a specific action zone as is indicated in step 416. For example, if the fob is outside of zones Y and Z, then manual actions associated with the field the user is positioned in may be permitted to be performed by the user. For example, if the fob is in the rear field 306 (but not in zones Y or Z specifically), then the user may be permitted to open the rear hatch or trunk (whereas without the fob in this zone, they would not be able to perform this action because the rear hatch or trunk would remain locked). Similarly the side doors may be openable when the user is in right side field 302 or left side field 304 (as is standard in many PEPS systems where the presence of the fob enables the user to manually perform certain actions that would otherwise be prohibited in the absence of a properly authorized or credentialed key fob).

It will be appreciated that while zones Y and Z are located near the tail lamps in this specific example using FIGS. 4 and 5, that these zones could be relocated or redefined.

In this way, it is contemplated that the system can be programmed to prevent inadvertent activation prevention while still providing multifunction performance based on fob position. Multiple zones can be created around the vehicle sensing the location of the vehicle fob to perform various different actions and the fob positioning around the vehicle will result in allowance of a finite number of vehicle function activations and preclude others from occurring.

Although specific embodiments are described above, it will be apparent to those of ordinary skill that a number of variations can be made within the scope of the disclosure. It should be understood, therefore, that the methods and apparatuses described above are only exemplary and do not limit the scope of the invention, and that various modifications could be made by those skilled in the art that would fall within the scope of the invention. To apprise the public of the scope of this invention, the following claims are made.

We claim:

1. A method for activating a device for an automotive vehicle, the method comprising:

generating a localized field using a field generator;

detecting the presence of a user in the localized field;

thereafter providing a perceivable system response acknowledging the presence of the user in the localized field; and selectively (A) activating the device if a detected direction of movement of the user is away from the field generator within a predetermined amount of time after the perceivable system response has been provided, thereby indicating an intent of the user to activate the device, and (B) not activating the device if a detected direction of movement of the user is not away from the field generator within a predetermined amount of time after the perceivable system response has been provided, thereby indicating an intent of the user to not activate the device.

2. The method of claim 1, wherein the field generator includes at least one of a Doppler generator, a capacitive sensor, a wireless communication device, a visual sensor, and an optical sensor.

3. The method of claim 1, wherein the device is a member selected from the group consisting of lift gates, sliding doors, hinged doors, gull wing doors, pick-up tail gates, power running boards, windows, dropping windows, sliding windows, flip windows, sun roofs, moon roofs, step-in features, locked cargo stowage boxes, hood presenters, deployable handles, and fuel door covers.

4. The method of claim 1, further comprising comparing the detected direction of movement of the user to an acceptable direction of movement of the user.

5. The method of claim 1, wherein the detected direction of movement of the user includes placing a hand of the user proximate to a gesture sensor of the automotive vehicle.

6. An automotive vehicle comprising a system programmed to perform the method of claim 1.

7. A system for an automotive vehicle programmed to perform the method of claim 1.

8. A method for activating a device for an automotive vehicle, the method comprising:

detecting a direction of a first predetermined motion of a user for activation of the device;

thereafter providing a perceivable system response acknowledging the first predetermined motion of the user for activation of the device; and selectively (A) activating the device if the detected direction of the first predetermined motion of the user is away from a field generator or if the user is detected to have moved in a direction of a second predetermined motion, thereby indicating an intent of the user to activate the device, and (B) not activating the device if the detected direction of the first predetermined motion of the user is not away from the field generator or if the user is detected to have not moved in the direction of the second predetermined motion, thereby indicating an intent of the user to not activate the device.

9. The method of claim 8, wherein the field generator includes at least one of a Doppler generator, a capacitive sensor, a wireless communication device, a visual sensor, and an optical sensor.

10. The method of claim 8, wherein the device is a member selected from the group consisting of lift gates, sliding doors, hinged doors, gull wing doors, pick-up tail gates, power running boards, windows, dropping windows, sliding windows, flip windows, sun roofs, moon roofs, step-in features, locked cargo stowage boxes, hood presenters, deployable handles, and fuel door covers.

11. The method of claim 8, further comprising comparing the detected direction of the first predetermined motion of the user to an acceptable direction of motion of the user.

12. The method of claim 8, wherein the detected direction of the first predetermined motion of the user includes placing a hand of the user proximate to a gesture sensor of the automotive vehicle.

13. An automotive vehicle comprising a system programmed to perform the method of claim 8.

14. A system for an automotive vehicle programmed to perform the method of claim 8.

15. A method for activating a device for an automotive vehicle, the method comprising:

monitoring for a gesture with a gesture sensor supported by the vehicle;

detecting a direction of movement of a gesture using the gesture sensor;

detecting a position of a key fob relative to the vehicle; and performing an action associated with the direction of movement of a gesture and the position of the key fob.

16. The method of claim 15, wherein the gesture sensor is supported by a tail lamp assembly of the vehicle.

17. The method of claim 15, wherein detecting a position of the key fob relative to the vehicle includes separately and simultaneously detecting the key fob using at least two independent sensors for detecting the key fob and wherein the at least two independent sensors for detecting the key fob define an overlapping area.

18. The method of claim 17, wherein the overlapping area includes an area including the gesture sensor.

19. The method of claim 15, wherein the gesture sensor includes at least two gesture sensors.

20. The method of claim 19, wherein the corresponding action associated with each of the at least two gesture sensors and the position of the key fob differs between the at least two gesture sensors.

21. The method of claim 15, wherein performing an action associated with the gesture and the position of the key fob includes opening a vehicle closure.

22. The method of claim 15, further comprising comparing the detected direction of movement of the user to an acceptable direction of movement of the user.

23. The method of claim 15, wherein the detected direction of movement of the user includes placing a hand of the user proximate to a gesture sensor of the automotive vehicle.

* * * * *